US007707731B2

(12) United States Patent
Johnson et al.

(10) Patent No.: US 7,707,731 B2
(45) Date of Patent: May 4, 2010

(54) MARKING DEVICE FOR ROTATIONAL MACHINES

(75) Inventors: Mark F. Johnson, Harrison, ID (US); Allan S. Johnson, Harrison, ID (US)

(73) Assignee: The Tapmatic Corporation, Post Falls, ID (US)

( * ) Notice: Subject to any disclaimer, the term of this patent is extended or adjusted under 35 U.S.C. 154(b) by 47 days.

(21) Appl. No.: 12/231,904

(22) Filed: Sep. 5, 2008

(65) Prior Publication Data

US 2010/0058604 A1 Mar. 11, 2010

(51) Int. Cl.
*B43L 13/00* (2006.01)

(52) U.S. Cl. ..... 33/18.1; 33/18.2; 33/666

(58) Field of Classification Search ..... 33/18.1, 33/18.2, 27.01, 32.1, 666, 670, 574
See application file for complete search history.

(56) References Cited

U.S. PATENT DOCUMENTS

| | | | | |
|---|---|---|---|---|
| 4,809,023 | A * | 2/1989 | Brunner et al. | 33/18.1 |
| 5,094,134 | A * | 3/1992 | Mizukoshi | 33/18.1 |
| 5,594,991 | A * | 1/1997 | Therond | 33/18.1 |
| 6,188,148 | B1 * | 2/2001 | Curreno | 310/12.05 |
| 6,427,357 | B1 * | 8/2002 | Piper | 33/666 |
| 6,824,337 | B2 * | 11/2004 | Pentz et al. | 409/132 |
| 2003/0048969 | A1 * | 3/2003 | Hunter et al. | 384/610 |

* cited by examiner

*Primary Examiner*—G. Bradley Bennett
(74) *Attorney, Agent, or Firm*—Wells St. John PS

(57) ABSTRACT

This invention discloses a component marking device to allow components to be marked by using the rotation provided by a CNC type of machine or other machine tool, and which utilizes a stylus which shares the same approximate axis of rotation as the CNC machine and which utilizes rotating impact balls to impart a strong throwing force on hammer pins and a hammer to cause the sudden downward movement of the stylus as desired.

5 Claims, 7 Drawing Sheets

MARKING DEVICE FOR ROTATIONAL MACHINES

CROSS REFERENCE TO RELATED APPLICATION

This application does not claim priority from any other application.

TECHNICAL FIELD

This invention pertains to a marking device for use on rotating machines to impart markings such as words and numbers in metal parts and other objects.

BACKGROUND OF THE INVENTION

For many manufactured work pieces it is desirable or required to place more permanent types of markings or identifying symbols and indicia there-on. Examples of such markings might be a trademark, a manufacturer, a part number, or some sort of design element.

In the more typical situation today, the parts are first manufactured by machining or otherwise and then marked by a separate stand alone marking or stamping device which must be separately acquired by the manufacturer. This is obviously an additional expense and an additional step in the manufacturing process which is desirable to eliminate.

It is desirable to have a tool or device which accomplishes the marking but eliminates the need to acquire or possess an additional marking device. Such a marking device may for instance utilize the drive or rotation from a CNC or other machine or device, and the marking device convert the rotation provided thereby to an axial movement to impart markings on a work piece. The programming and X-Y movement (as well as the Z plane) capability and programming of the CNC or other machine may then be utilized to accomplish the marking task. While there is a prior marking device which utilizes a CNC or other machine for its rotation to impart markings on a work piece, as described in U.S. Pat. No. 6,427,357, it does not provide all the desirable features, advantages and drive mechanisms as this invention. U.S. Pat. No. 6,427,357, for instance, utilizes an off-set marking stylus (off-set from the axis of rotation of the spindle from the CNC machine). From a programming, process control and mechanical perspective, it is desired to have a marking device wherein the stylus is at or very near the axis of rotation of the machine or device providing the rotation (substantially or approximately co-axial), such as a CNC machine or other device.

It may also be desirable from a reliability and wear perspective to utilize impact ball (preferably impact ball) technology to transform the rotation force provided by the CNC machine (or other machine tool) to axial impact force on a stylus and rapid axial movement of a stylus at a relatively low revolutions per minute (RPM) in order to strike two or more times per revolution of the CNC with sufficient force to throw it against the work piece and thereby produce the indentations, marks and/or dots.

It is an object of some embodiments of this invention to provide a reliable, longer lasting, marking device to convert the rotation of the CNC or other machine to axial impact force on a stylus marking a work piece.

It is a further object of some embodiments of this invention to provide such a marking device which reliably provides an impact force downward on the stylus marking point, which utilizes a more reliable mechanism in hammering the stylus down, and which may reduce wear.

While the invention was motivated in addressing certain identified problems or desired advantages, it is not so limited. The invention is only limited by the accompanying claims as literally worded, without interpretative or other limiting reference to the specification, and in accordance with the doctrine of equivalents.

Other objects, features and advantages of this invention will appear from the specification, claims, and accompanying drawings which form a part hereof. In carrying out the objects of this invention, it is to be understood that its essential features are susceptible to change in design and structural arrangement, only practical a preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
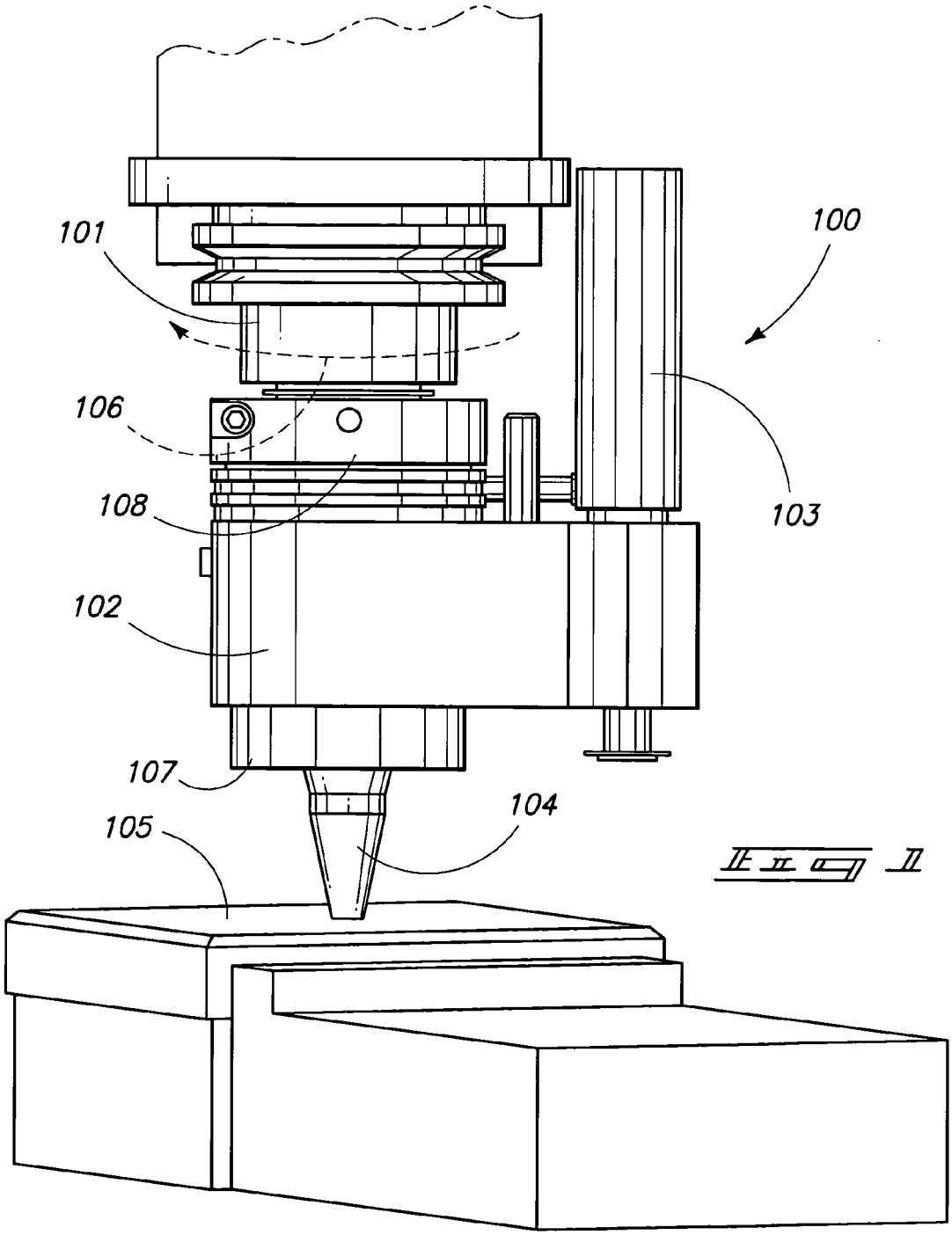
FIG. 1 is a front elevation view of one example of an embodiment of this invention.

FIG. 1 is a front elevation view of one example of an embodiment of this invention. FIG. 1 shows the dot marking device 100, CNC machine component 101 which provides rotation as indicated by arrow 106 to the dot marking device 100. The CNC machine provides X-Y lateral movement and Z axis movement. FIG. 1 further shows marking device body 102 (non-rotating), spring-loaded stop arm 103, stylus housing 104, marking device rotating body 108, non-rotating housing cover 107, and work piece 105. The stylus housing 104 and housing cover 107 may also be considered part of the overall housing of the marking device.

Figure 2:
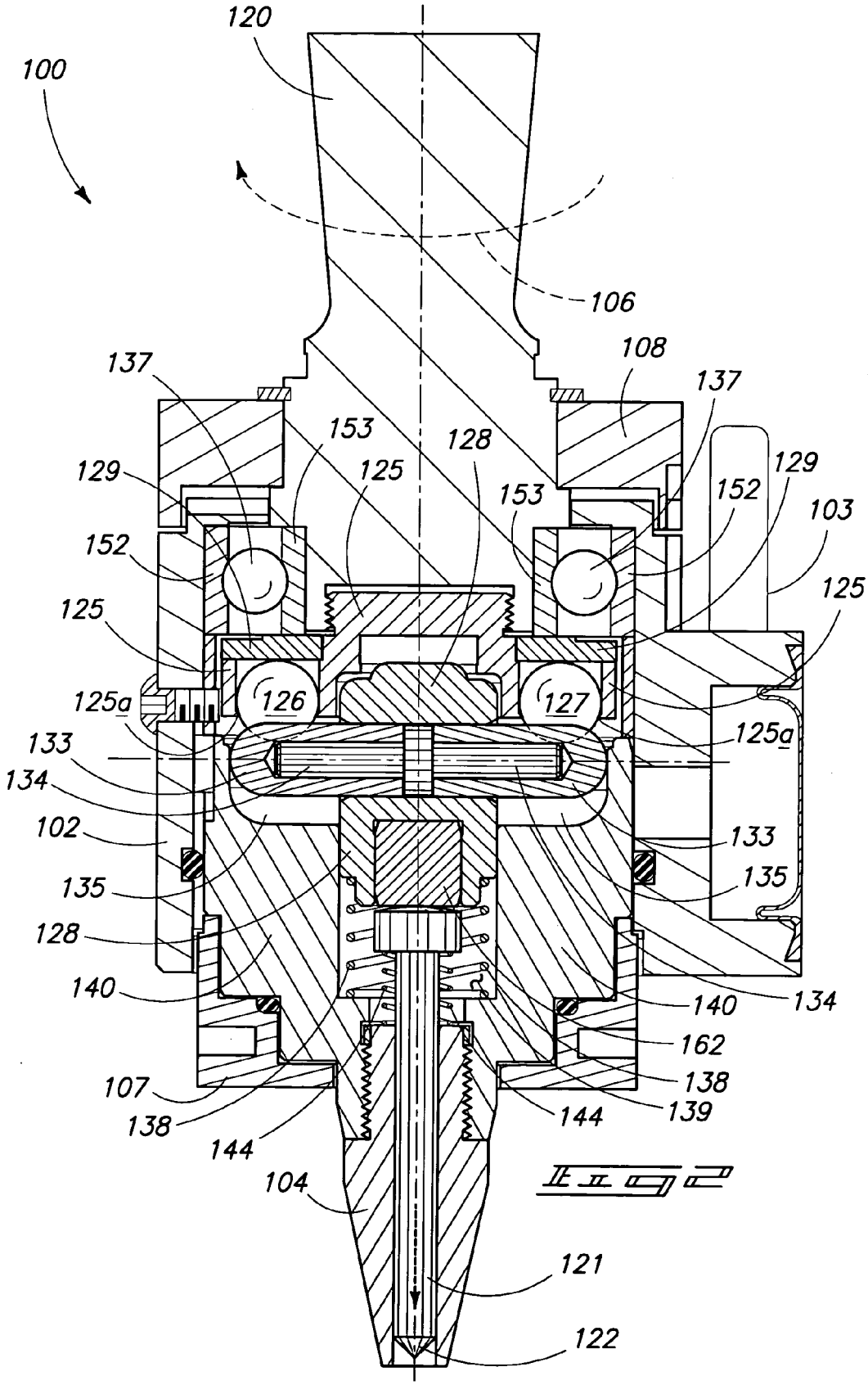
FIG. 2 is an elevation cross-sectional view of an example of an embodiment of this invention.

FIG. 2 is an elevation cross-sectional view of an example of an embodiment of this invention. FIG. 2 shows the dot marking device 100 wherein the CNC machine is rotating the shank or machine spindle interface 120 as indicated by arrow 106, thereby rotating spin body portions 108 while device body 102 is stationary as stop arm 103 prevents its rotation. FIG. 2 further illustrates hammer 128, hammer pins 133, hammer pin guide 135 and hammer guide 139 within non-rotating hammer carrier 140, with hammer spring 138 providing the biasing force toward the retraction of the hammer 128.

It will be appreciated by those of ordinary skill in the art that the machine spindle interface 120 shown in this example or embodiment, is a shank or straight shank; however any one of a number of other interfaces may be utilized depending on what machine spindle the embodiment is being used with. It may for example but not by way of limitation, be referred to as an adapter, a taper mount, a threaded mount, or a straight shank, with no one being required to practice the invention. In some other examples a second adapter piece may be provided to further adapt the machine spindle interface 120 to the machine spindle, all within the contemplation of this invention and all as known in the art.

Figure 7:
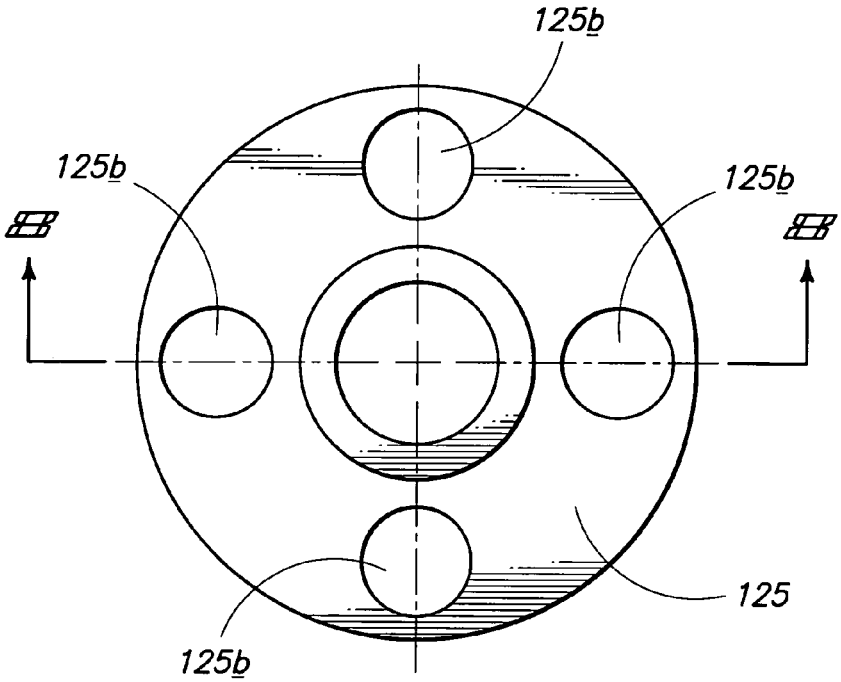
FIG. 7 is a top view of impact ball holder with four impact balls shown.

As can be seen from FIG. 2, impact balls 126 and 127 are in an impact ball holder 125 comprised of holder side walls and impact ball plate 129 (which is shown in FIG. 7 for a four impact ball configuration) for impact ball 126 and holder side walls and impact ball plate 129 for impact ball 127. FIG. 2 further illustrates a small shoulder 125*a* on holder side walls 125 which retains the impact balls 126 and 127 in that location while still allowing them to rotate. The small shoulders are also believed to reduce the wearing on the surface of the hammer carrier 140 and/or hammer pins 133. It should also be noted that while two impact balls 126 and 127 are shown in FIG. 2, more balls may be used in more compartments in order to achieve the operating characteristics desired, such as more strikes per minute if four impact balls are used, or six impact balls are used, all within the contemplation of this invention. While it is preferred that the impact balls be spherically shaped and made of suitable steel or other metal, it should be noted that this invention is not limited to any particular material.

As the machine spindle interface 120 is rotated as shown by arrow 106, this causes the impact ball holder 125 to rotate and causes the impact balls 126 and 127 to impact hammer pins 133, thereby driving the hammer 128 downwardly against the spring biased force provided by spring 138, and consequently throwing or pounding stylus 121 downwardly as indicated by arrow 171. The stylus point 122 is thrown downwardly to impart indentations, dots or markings on a work piece. The downward throwing of the stylus overcomes the force of the stylus spring 138 holding it and moves the stylus 121 downward out of the stylus housing 104 to hit the work piece (an extended position), and then the hammer spring 144 force pushes the hammer back upward and the force from the stylus spring 144 pushes the stylus 121 back upward and into the stylus housing 104 (into a retracted position), in a reciprocating motion. The stylus 121 is shown co-axial or approximately co-axial with the machine spindle interface 120 within reasonable tolerances.

While it will be appreciated by those of ordinary skill in the art that any one of a number of different materials may be utilized for the components described herein, in some embodiments the hammer pin axle 134 may be comprised of aluminum bronze, as well as the hammer 128. The placement of the hammer pins 133 on hammer pin axle 134 gives the hammer pins 133 the ability to rotate as they are struck by the impact balls, thereby potentially spreading out the wear over the entire circumference and reducing the wear on the hammer pins 133 and/or on the impact balls 126 and 127.

FIG. 2 further shows that the hammer 128 in this embodiment includes an impact portion 162 which is the impact portion that is thrown into and pounds the top of stylus 121. Stylus spring 144 provides resistance from the downward movement of the stylus 121 and then asserts the biasing force which moves the stylus 121 vertically to return to its retracted position after the over-powering force imparted by the hammer 128 ceases. The stylus 121 is thrown downwardly to an extended position by the impact of the hammer 128 overcoming the biasing force of the stylus spring 144, in what may be referred to as a reciprocating motion. While the terms retracted position and extended position are used herein, they do not refer to any one specific position, but instead may vary with the application of the invention. For instance the extended position for a given marking may be any one or more specific positions of extension.

FIG. 2 also illustrates the rotational buffer between rotating and non-rotating components, as described more fully herein. Bearings 137 combine with wall 152 and 153 to provide an interface between the spindle interface 120 and the non-rotating housing for example. Said interfaces are well known and used in the art and will not therefore be described in more detail hereon.

Figure 3:
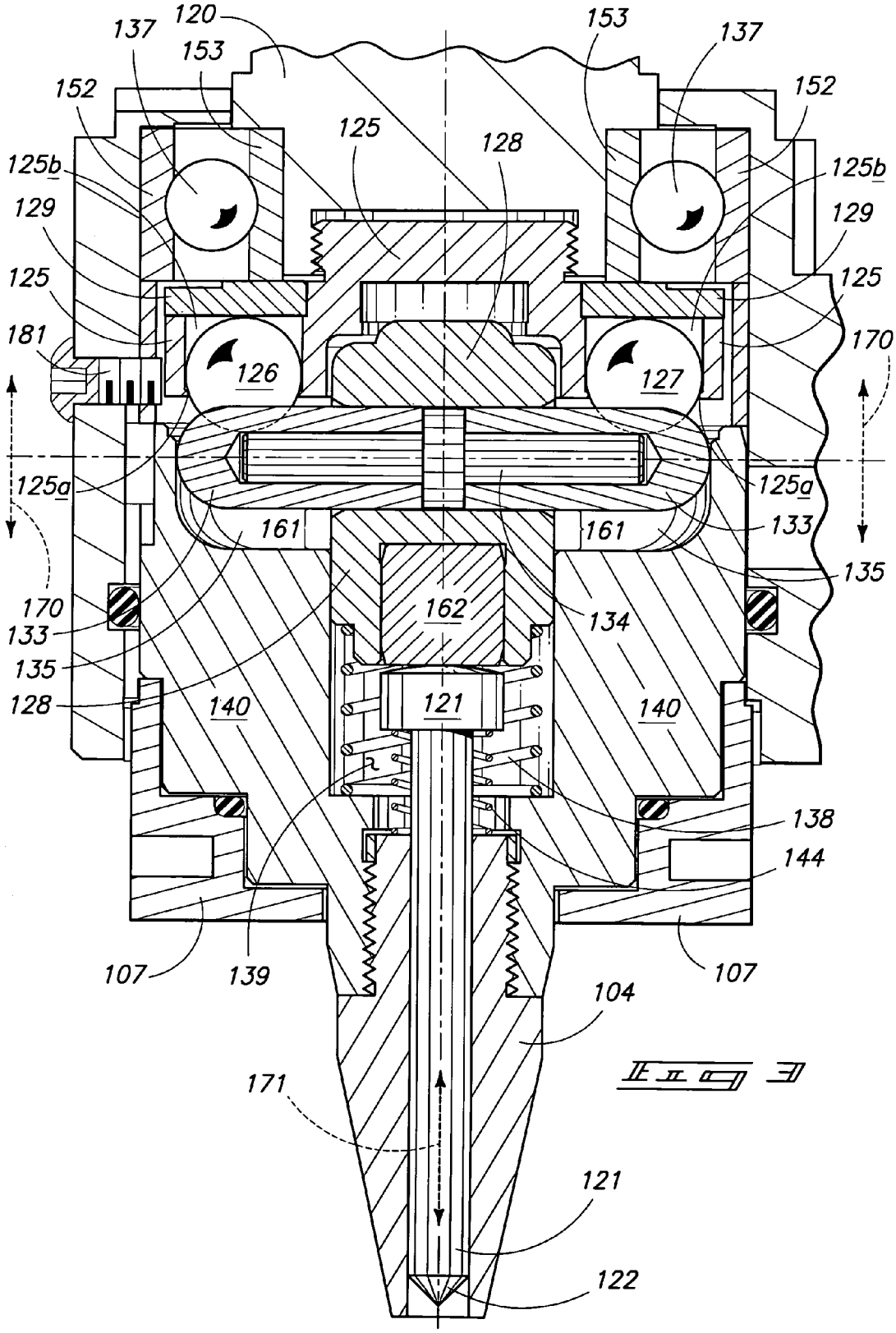
FIG. 3 is a cross-sectional elevation view of the embodiment of this invention illustrated in FIG. 2 with the stylus in an upward or retracted position.

FIG. 3 is a cross-sectional elevation view of the embodiment of this invention illustrated in FIG. 2 with the stylus in an upward position, which may also be referred to as a retracted position. The like numbered items in FIG. 3 are the same as those in FIG. 2 and will not therefore be repeated here. FIG. 3 illustrates hammer pin cavity 135, which is also a hammer pin guide, and a distance between the bottom of hammer pin cavity 135 and the hammer pins 133 as represented by distance 161. The hammer pins 133 are shown overlapping impact balls 126 and 127 and as the impact balls 126 and 127 rotate about the machine spindle interface axis with the spindle, the impact balls 126 and 127 impact the hammer pins 133 causing them to be thrown or driven downwardly as the outer arcuate or curved surface of the impact balls 126 and 127 interact with the generally cylindrical outer striking surface of hammer pins 133. This may cause both the impact balls 126 and 127, and the hammer pins 133 to rotate about their axis while causing the downward movement of the hammer pins 133, the downward movement of the hammer into the stylus 121 and consequently the downward movement of the stylus 121 for imparting a dot, indentation or marking as desired on a work piece.

Figure 4:
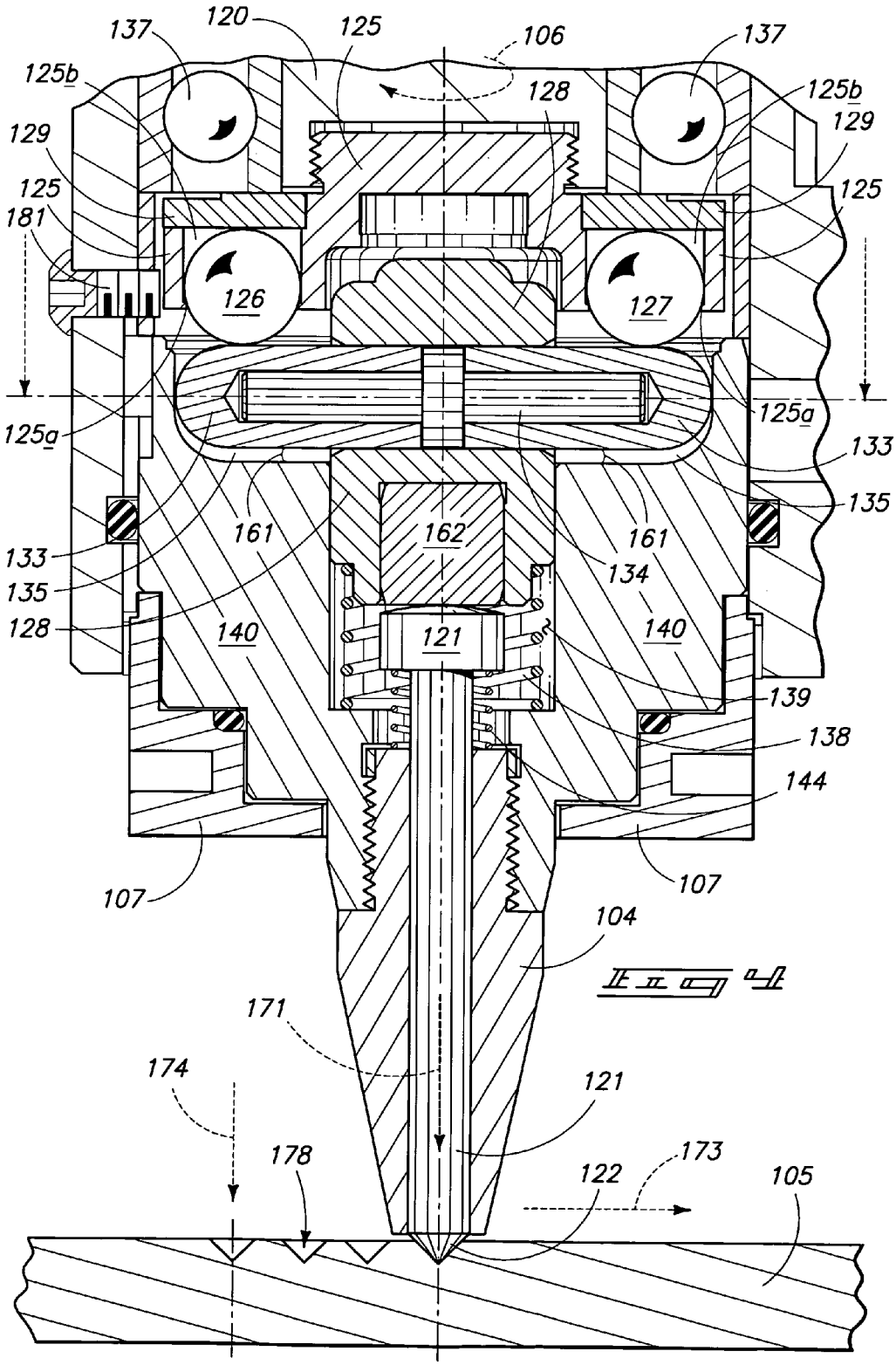
FIG. 4 is a cross-sectional elevation view of the embodiment of this invention illustrated in FIG. 3 with the stylus in a downward, extended or striking position.

FIG. 4 is a cross-sectional elevation view of the embodiment of this invention illustrated in FIG. 3 with the stylus in a downward, extended or a striking position (into the work piece). The like numbered items in FIG. 4 are the same as those in FIG. 2 and FIG. 3, and will not therefore be repeated here. FIG. 4 illustrates the position or configuration when impact balls 126 and 127 have impacted the hammer pins 133 and moved the hammer pins downwardly to an extended position. The impact between the impact balls 126 and 127 and the hammer pins 133 causes the downward movement of the hammer pins 133 so that the impact balls 126 and 127 are above (instead of overlapping) the hammer pins 133. Distance 161 between the hammer pins 133 in the bottom of the hammer pin guide 135 in hammer carrier 140 illustrates the amount of downward movement, and the indentation 178 illustrated on work piece 105 shows that downward movement of stylus 121 in response to the impact of the hammer 128 on the stylus 121, thereby causing indentations, dots or markings on work piece 105. Arrow 171 indicates the downward movement of stylus 121. Hammer guide 139 is shown in hammer carrier 140 and which provides the guide and aperture to control the reciprocal movement of the hammer 128.

The software or programming for the CNC machine may then be utilized for engraving by moving the machine spindle to produce letters, marks or designs consisting of a series of dots, markings or indentations, such as shown by arrow 173 in FIG. 4. The speed of rotation for the marking of dots or indentations may be any one or more of a number of different speeds, for example, but not by way of limitation, three hundred (300) revolutions per minute (rpm) and up to one thousand (1000) rpm's or more, depending on the number of impact balls being used. The distance between dots or indentations may be controlled by the feed rate program into the CNC machine itself. The desired depth of the dot, indentation or mark may be determined by the distance the stylus moves before contacting the work piece surface and the velocity of the stylus which is controlled by the revolutions per minute of the machine spindle, or any one of a number of other parameters, all within the contemplation of this invention.

Figure 5:
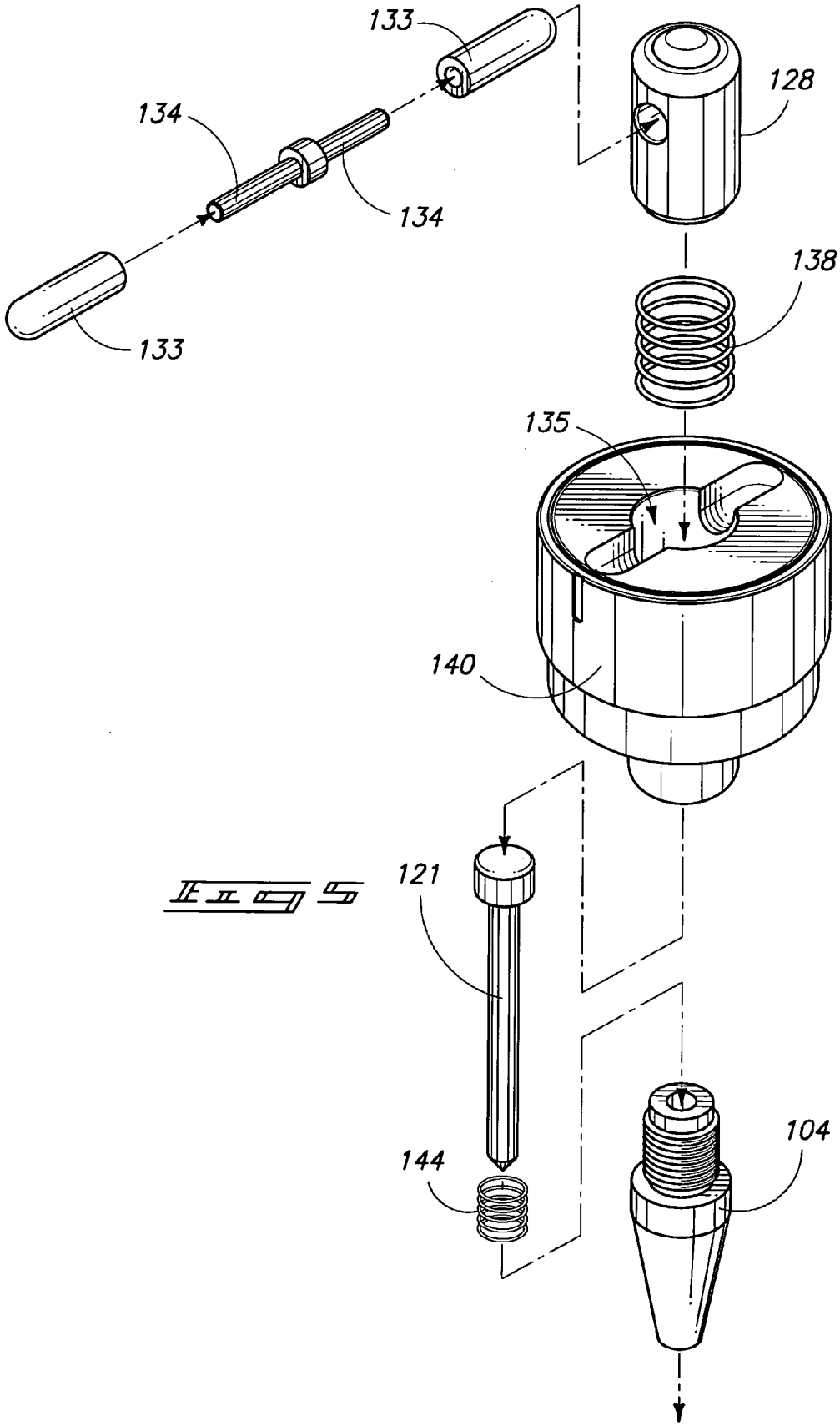
FIG. 5 is an exploded perspective view of one example of a hammer carrier or guide, hammer and other components which may be utilized in some embodiments of this invention, showing two hammer pins.

FIG. 5 is an exploded perspective view of one example of a hammer carrier 140, hammer 128 and other components which may be utilized in some embodiments of this invention, showing two hammer pins 133. FIG. 5 illustrates hammer carrier 140, hammer 128, hammer pins 133 and hammer pin axle 134. In order to better facilitate the impact between hammer pin's 133 and the impact balls 126 and 127 as shown in FIG. 4, the hammer pins 133 may be rotatably mounted such as on hammer pin axle 134 to allow the rotation of hammer pins 133 about hammer pin axle 134 to reduce the wear on both hammer pins 133 and on impact balls 126 and 127. The hammer carrier 140 is shown with hammer pin cavity 135, which is a hammer guide and a hammer pin guide. The hammer spring 138 is in this application inserted over a lower portion of the hammer 128 within hammer carrier 140 (in this embodiment) and provides a biasing force upward on the hammer 128 to remain in the retracted position until thrown downwardly by the impact of impact balls (not shown in this figure) on hammer pins 133. Stylus 121 is shown with stylus spring 144 and as it is assembled within an aperture in stylus housing 104.

Since the hammer pins 133 are each independently and rotatably mounted on hammer pin axle 134, each rotates independently of the other because they are each being hit by the impact balls, which would make one hammer pin rotate the opposite direction from the other hammer pin opposite it on the hammer pin axle 134: The hammer pins 133, which also may be referred to as rollers in some embodiments, may be rotatably mounted about an axle, and are positioned or contained within a portion of the hammer 128 (through an aperture in the hammer) in this embodiment to impart the impact from the impact balls through the hammer pins 133 to the hammer 128. The hammer 128 may but need not be constructed from aluminum bronze or from a material referred to as "nylatron GS" (as two examples of many possibilities, within the contemplation of this invention). The material may be chosen for a given application as desired to reach the anti-friction and hardness properties desired. The rollers or pins 133 for example may be steel hardened to 62 RC hardness.

In general, by containing the hammer pins 133 or rollers within the hammer and utilizing a centralized hammer which has the same approximate axis of rotation as the machine spindle, this ensures that the impact from the hammer 128 to the stylus directly results from the impact of the impact balls 126 and 127 against the hammer pins 133, and it is all axial or approximately axial to the axis of the machine spindle interface. In contrasting the center line device from an off-center device, side impact on the stylus is eliminated and wear is believed to be minimized as a result. The impact balls 126 and 127 are contained within compartments or areas defined by impact ball holder 125 and impact ball plate 129 (as shown more fully in FIG. 8), which may be any material with desirable characteristics or properties, such as aluminum bronze plating, tool quality steel or other suitable material (with no particular material is required to practice this invention). The combination of the impact ball compartments 125*b* in the impact ball holder 125, with the impact ball plate 129 retain or contain the impact balls in position (the small shoulders 125*a*) such that they are not clamped or fixed, and are permitted to rotate.

Figure 6:
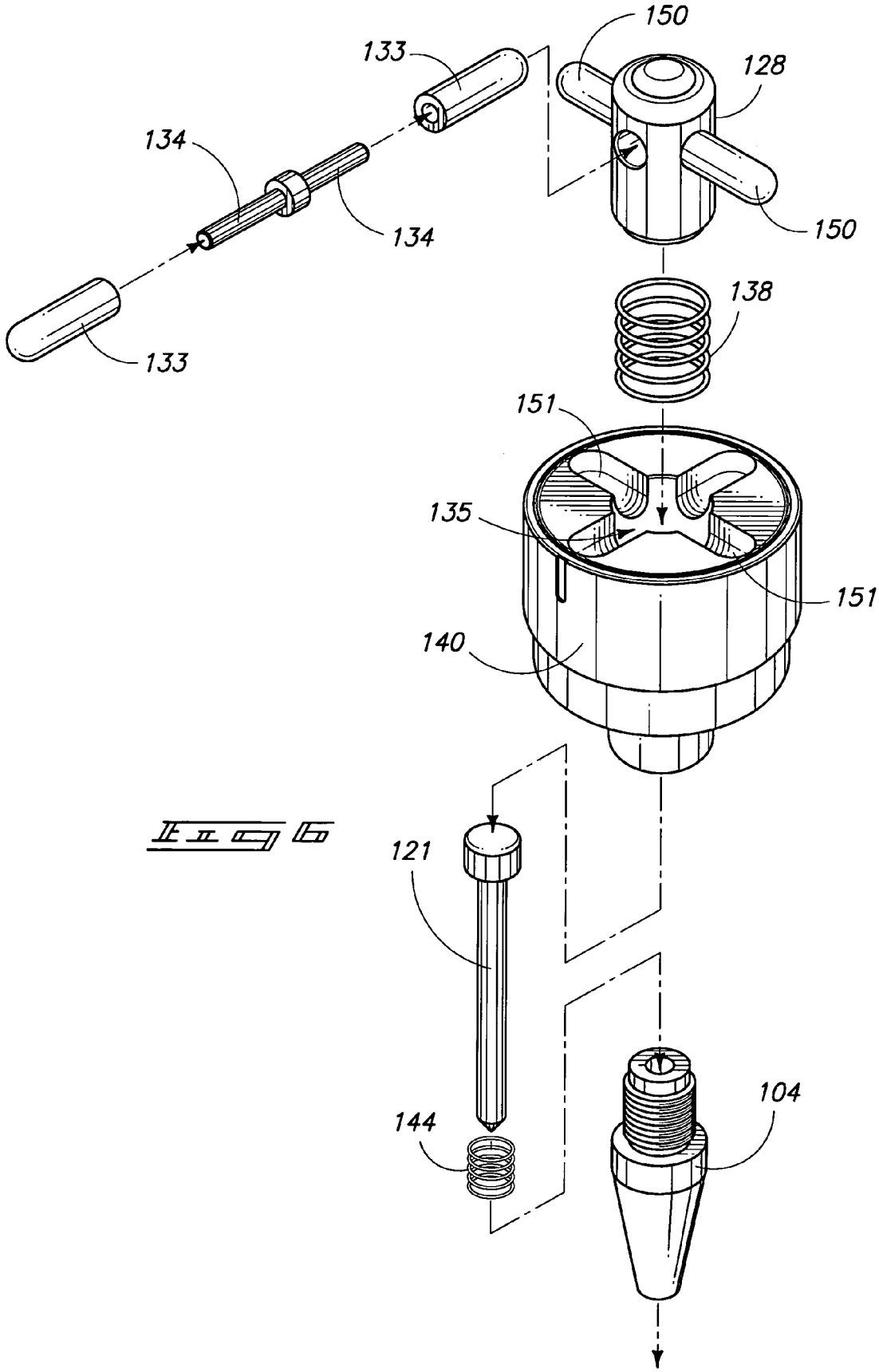
FIG. 6 is an exploded perspective view of one example of a hammer carrier, hammer, hammer pin and other components which may be utilized in some embodiments of this invention, showing four hammer pins.

FIG. 6 is an exploded perspective view of one example of a hammer carrier, hammer and other components which may be utilized in some embodiments of this invention, showing four hammer pins 133 and 150. The like numbered items in FIG. 6 are the same as those in FIG. 5, and will not therefore be repeated here. FIG. 6 illustrates the additional two hammer pins 150 and hammer pin cavities 151 for the second set of hammer pins 150 within hammer pin carrier 140, which are also hammer pin guides. The hammer pin guides 140 and the hammer guide (the center portion of the hammer carrier) allow vertical movement of the hammer 128 and hammer pins 133 and 150 in the direction of the axis of the machine spindle interface and stylus, but restrict the lateral movement, including rotational movement about the axis of the spindle holder.

FIG. 6 illustrates that the invention may be utilized with either one set of hammer pins 133 or two sets of hammer pins 133 and 150, and it is preferable that they be mounted ninety degrees apart from one another as shown in FIG. 6 if two sets are going to be used. If a configuration is utilized with four hammer pins as shown in FIG. 6, it allows for more dots or markings per second to be imparted on the work piece by the stylus 121 which can provide improved markings or lettering sported signs on the work piece.

FIG. 7 is a top view of impact ball holder 125 with four impact ball compartments 125*b* or areas shown therein. It will be noted that the impact ball holder 125 is a rotating part operatively attached to the machine spindle interface (shown in other figures) and which provides the rotation for the impact balls to impact the hammer pins (also shown in other figures).

Figure 8:
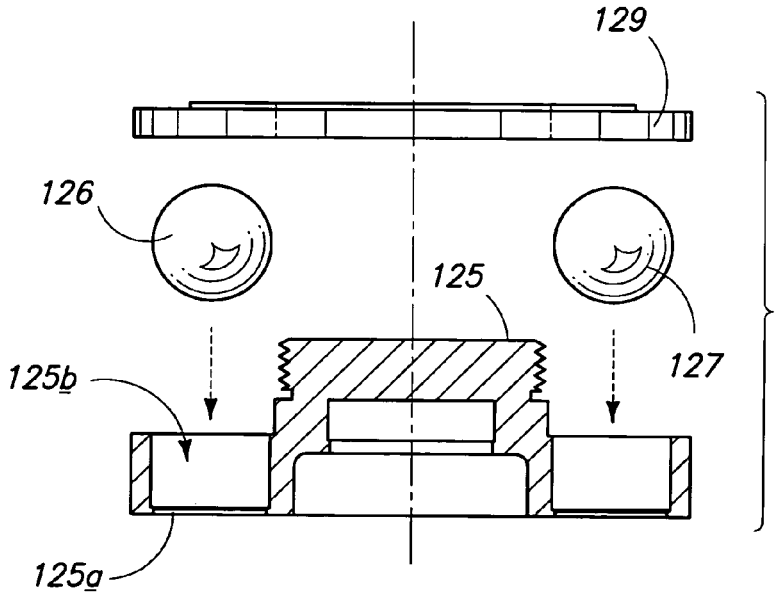
FIG. 8 is a part cross-sectional view of the impact ball holder with impact balls and impact plate shown in an exploded view above the cross-sectional of the impact ball holder.

FIG. 8 is a part cross-sectional view of the impact ball holder 125 with two impact balls 126 and 127 shown in an exploded view way above the impact ball holder (although four impact balls would be likely be used in the example of this embodiment of the invention shown) and above the impact ball compartments 125*b* in the impact ball holder 125. Impact ball plate 129 is also shown in an exploded view way above the impact balls 126 and 127, and above the cross-sectional of the impact ball holder 125.

The exploded view shown in FIG. 8 would appear above the exploded view from FIG. 5 for example above hammer 128.

As will be appreciated by those of reasonable skill in the art, there are numerous embodiments to this invention, and variations of elements and components which may be used, all within the scope of this invention.

In one embodiment for example, a marking device for use with a CNC machine or other machine tool is provided and that marking device comprises: a non-rotating housing; a stylus movably supported by the housing from a retracted position to an extended position; a stylus spring mounted relative to the stylus to move it to its retracted position; a machine spindle interface rotatably mounted to the housing and disposed to be rotated by a CNC or other machine tool; at least two impact balls rotatably supported within the housing and operatively attached to rotate with the machine spindle interface; a non-rotating hammer disposed at an upper end to be approximately simultaneously impacted by the at least two impact balls, and disposed at a lower end to drive the stylus to an extended position; and wherein the stylus is approximately co-axial with the machine spindle interface.

It will be noted that the preceding embodiment may be wherein the hammer comprises a vertically oriented hammer with hammer pins rotatably mounted and laterally disposed, and including a cylindrically shaped outer striking surface disposed to be impacted by the at least two impact balls rotating with the machine spindle interface. This application may be still further wherein the at least two impact balls are configured to simultaneously strike the hammer pins spaced approximately one hundred eighty degrees apart and further wherein the at least two impact balls and the hammer pins may rotate upon impact. The foregoing application may be still further wherein the hammer and hammer pins are disposed within a hammer guide and hammer pin guide which guides vertical movement of the hammer and the hammer pins, but which restricts lateral movement thereof.

It will be noted that the foregoing may be further comprising at least four impact balls rotatably supported within the housing and further wherein the hammer is disposed at an upper end to be approximately simultaneously impacted by the at least four impact balls.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A marking device for use with a CNC machine or other machine tool, comprising:

a non-rotating housing;

a stylus movably supported by the housing from a retracted position to an extended position;

a stylus spring mounted relative to the stylus to move it to its retracted position;

a machine spindle interface rotatably mounted to the housing and disposed to be rotated by a CNC or other machine tool;

at least two impact balls rotatably supported within the housing and operatively attached to rotate with the machine spindle interface and about an axis of rotation of the machine spindle interface;

a non-rotating hammer disposed at an upper end to be approximately simultaneously impacted by the at least two impact balls, and disposed at a lower end to drive the stylus to an extended position; and wherein the stylus is approximately co-axial with the machine spindle interface.

2. The marking device as recited in claim 1, and further comprising at least four impact balls rotatably supported within the housing and further wherein the hammer is disposed at an upper end to be approximately simultaneously impacted by the at least four impact balls.

3. The marking device as recited in claim 1, and further wherein the hammer comprises a vertically oriented hammer with hammer pins independently and rotatably mounted in a lateral disposition from the axis of the machine spindle interface, and including a cylindrically shaped outer striking surface disposed to be impacted by the at least two impact balls rotating with the machine spindle interface.

4. The marking device as recited in claim 3, and further wherein the at least two impact balls are configured to simultaneously strike the hammer pins spaced approximately one hundred eighty degrees apart and further wherein the at least two impact balls and the hammer pins may rotate upon impact.

5. The marking device as recited in claim 4, and further wherein the hammer and hammer pins are disposed within a hammer guide and hammer pin guide which guides vertical movement of the hammer and the hammer pins, but which restricts lateral movement thereof.

* * * * *